US005628266A

United States Patent [19]

Jurriëns et al.

[11] Patent Number: 5,628,266

[45] Date of Patent: May 13, 1997

[54] WINDSURFER MAST DEFLECTOR

[76] Inventors: Roger Jurriëns, L.G. Smith Boulevard 472-P.O. Box 461, Malmok, Aruba; John M. Parton, 13623 Northumberland Cir., Wellington, Fla. 33414

[21] Appl. No.: 541,741

[22] Filed: Oct. 10, 1995

[51] Int. Cl.[6] ..... B63B 35/79

[52] U.S. Cl. ..... 114/39.2; 114/91; 114/219

[58] Field of Search ..... 114/91, 39.2, 89, 114/90, 219

[56] References Cited

U.S. PATENT DOCUMENTS

| | | | |
|---|---|---|---|
| 3,707,935 | 1/1973 | Rachie | 114/39.2 |
| 4,437,424 | 3/1984 | Lord | 114/91 |
| 4,466,375 | 8/1984 | Marker | 114/90 |
| 4,624,204 | 11/1986 | Temple | 114/91 |
| 4,706,590 | 11/1987 | Hoyt | 114/91 |
| 4,730,568 | 3/1988 | Campbell | 114/39.2 |
| 4,740,182 | 4/1988 | Pertramer | 441/74 |
| 4,792,316 | 12/1988 | Skedeleski et al. | 441/74 |
| 4,825,792 | 5/1989 | de Vos | 114/90 |

*Primary Examiner*—Sherman Basinger
*Attorney, Agent, or Firm*—Quarles & Brady

[57] ABSTRACT

This invention relates to an apparatus for protecting the bow of a sailboard from damage caused by a falling mast and boom assembly, and includes at least one deflecting surface and structure for supporting the deflecting surface forward of the mast and above the board surface. The apparatus is preferably aligned substantially with a longitudinal axis of the board. The deflecting surface will deflect the mast to either lateral side of the sailboard whenever the mast and boom assembly moves forward toward the bow, preventing direct impact and damage to the bow. A sailboard and a method for preventing damage to the sailboard are also disclosed.

16 Claims, 4 Drawing Sheets

WINDSURFER MAST DEFLECTOR

BACKGROUND OF THE INVENTION

This invention relates to a device for a sailboard, and specifically to a protective deflector for preventing the mast and boom assembly of the sailboard from striking the bow of the sailboard.

The sport of sailboarding, or windsurfing, has developed into a world-wide industry. Advanced technology has been applied to the construction of the sailboard, including the board, the mast and boom assembly, the sails and the various devices for securing the mast and boom assembly to the body.

The board has a shape similar to the common surfboard, with some differences. The board usually provides a slot running along, or a hole centered upon, the longitudinal axis of the board for securing the mast to the board. The starboard and port sides of the board are a distance apart at the aft portion of the board and, as the sides approach the bow, the sides gradually slope towards the longitudinal axis of the board until they meet at the bow. The board has an upwardly-increasing slope in the vicinity of the bow. The bow of the sailboard functions like the bow of a ship, in that it parts the water towards the starboard and port sides.

There are drawbacks to the combination of the surfboard-like shape. When a windsurfer falls off the sailboard the mast is released or, on some occasions, the mast and the windsurfer are catapulted forward by an extreme gust of wind. It is quite common for the mast and boom to fall directly forward and strike the bow. When this occurs, and particularly when the windsurfer is catapulted, the force of the mast against the bow can crack or break the board because the bow receives the full force of the mast. On the other hand, when the mast hits the port, starboard, or aft edges, there is typically little or no damage to the board because the curvature of these sides and the angle between the mast and these sides causes the mast to be deflected, without delivering the full force of the mast to the surface. It would be desirable to prevent such damage to the bow of the sailboard.

SUMMARY OF THE INVENTION

It is an object of the invention to prevent damage to the bow of a sailboard caused by a falling mast and boom assembly.

In the present invention, the sailboard mast deflecting apparatus includes a device for deflecting the mast that is secured to the board such that a mast and boom assembly, falling towards the front tip or bow of the board, will be deflected to either the port or starboard side by the deflecting device prior to contact between the mast and the front tip of the board. In the preferred embodiment, the deflecting device includes a base, at least one deflecting surface, and structure for supporting the deflecting surface above the base. The device can be formed as a part of the board or as a separate structure for attachment to the board.

The mast deflecting device can be positioned close to the base of the mast and centered on the longitudinal axis of the board. The deflecting device can be secured to the board in the same manner that the mast is secured to the board. The deflecting device may be releasably engaged to the board such that the device can be removed when the sailboard is not in use. The deflecting device can also be securably adjustable so that the device can be positioned in a variety of positions along the longitudinal axis of the board.

Further objects and advantages of the invention will become apparent from an inspection of the drawings and detailed description of the invention which follows.

DETAILED DESCRIPTION OF THE INVENTION

Figure 1:
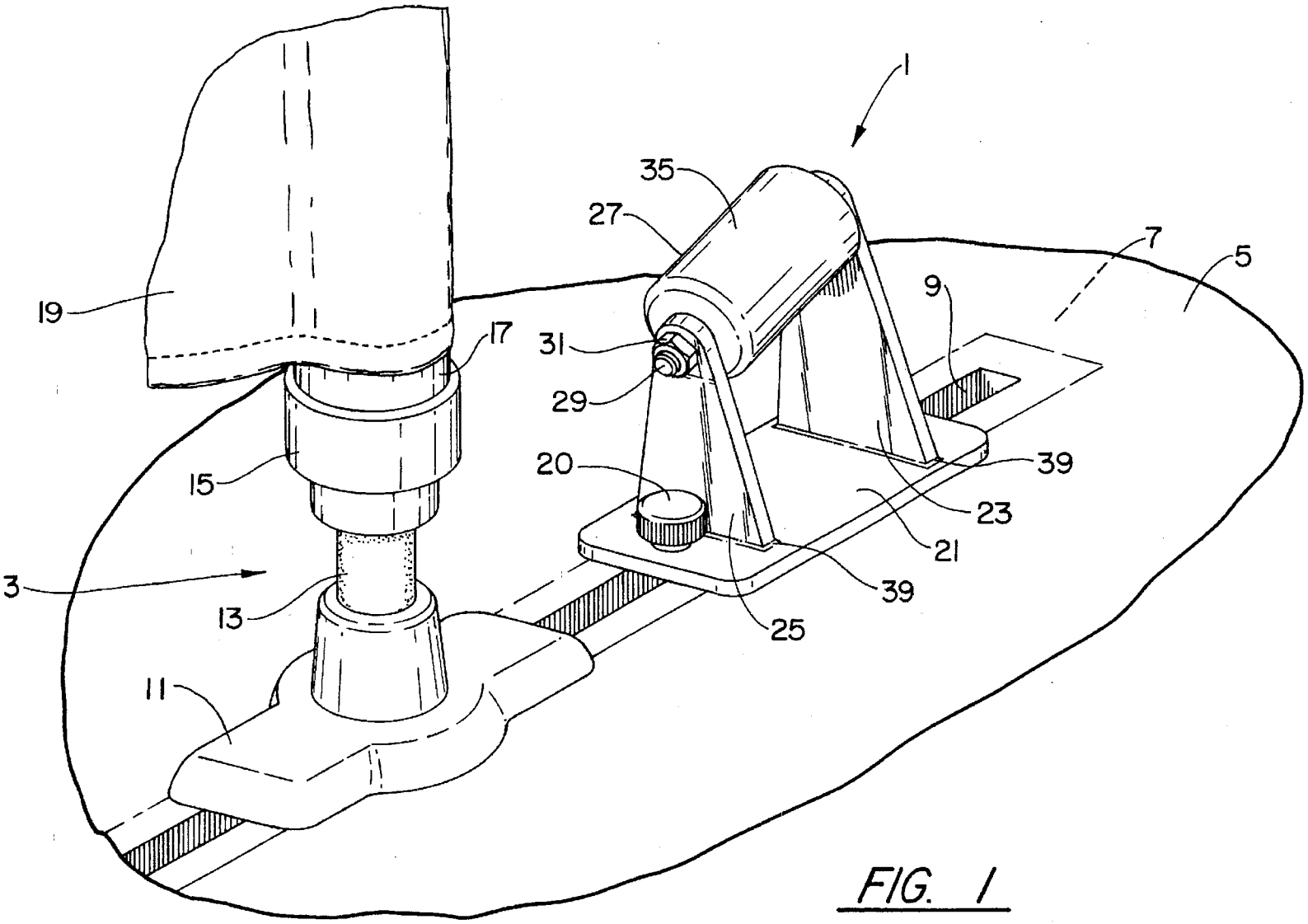
FIG. 1 is a perspective view of a portion of a sailboard including a mast deflecting device according to the invention.

FIG. 1 shows the mast deflecting device 1 and a mast assembly 3 positioned on the top surface of a sailboard 5. A mast track 9 is provided along the longitudinal axis 7 of the sailboard 5. The mast deflecting device includes a deflecting surface, and structure for supporting the deflecting surface over the sailboard 5. The mast deflecting device preferably also has structure for securing the mast deflecting device to the sailboard 5.

The mast assembly 3 shown in FIG. 1 is typical to sailboards known in the art. The mast assembly 3 has a mast base 11, a mast base fastener (not shown), a mast connector 13, a mast collar 15 and a mast 17 with a sail 19. To bring the mast base fastener into securing engagement with the mast track 9 and sailboard 5, the mast base fastener is placed into the mast track 9 and the mast base 11 is securably rotated into the mast base fastener. A mast collar 15 is attached to the base of the mast 17 and the mast connector 13 connects the mast collar 15 to the mast base 11. The mast connector 13 can be any of several suitable connectors such as an elastic band, a pivot joint, or a ball joint.

The deflecting surface is preferably elongated and sloped, angled or curved toward each lateral side of the deflecting surface. In one embodiment, the deflecting surface is provided as part of one or more deflecting rollers. The deflecting device can alternatively be formed as a single, unitary piece with the deflecting surface forming part of the piece. The deflecting surface is preferably secured to the sailboard 5 in an orientation that is substantially aligned with the longitudinal axis 7 of the sailboard. A mast striking the surface will be directed to either lateral side of the deflecting surface, and away from the bow of the sailboard 5.

The mast deflecting device 1 is preferably placed close to the mast base 11 on the top surface of the sailboard 5. Such placement keeps the mast deflecting device 1 out of the way of the rider, where it otherwise could interfere with foot placement or result in injury. This placement also permits the deflecting device 1 to alter the path of the mast away from the bow 33 (FIG. 4) of the sailboard before the mast has generated a large momentum in the direction of the bow 33.

The deflecting device can be secured to the board in a variety of ways. Preferably, the device can be securably engaged within the mast track 9 that is provided in the top of many sailboard designs, by utilizing bolts 20 which engage a corresponding connector. Examples of such securable engagement can be found in U.S. Pat. No. 4,740,182 to Pertramer and U.S. Pat. No. 4,730,568 to Campbell, the disclosures of which are incorporated fully by reference. Alternatively, the deflecting device can be more permanently secured to the sailboard 5, along the axis 7 between the mast base 11 and the bow 33.

Figure 2:
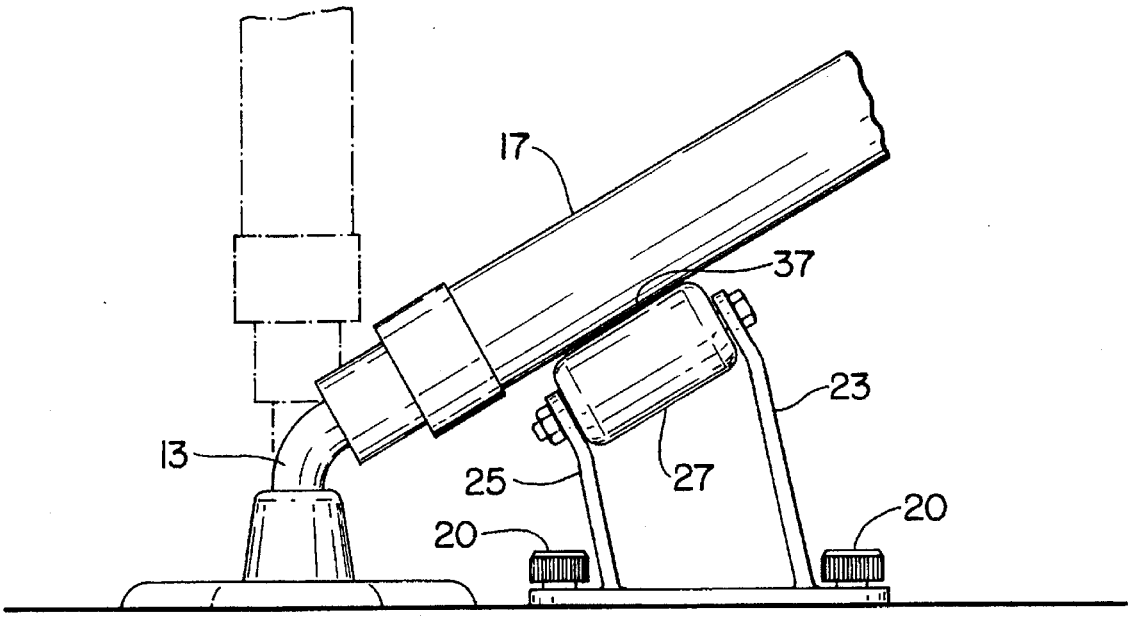
FIG. 2 is a plan view of the mast deflecting device in deflecting engagement with the mast, with the upright position of the mast in phantom.

In one embodiment of the mast deflecting device that is shown in FIGS. 1–2, a base plate 21, a fore strut 23, and an aft strut 25 are provided. A fastener can be used to attach the fore and aft struts 23, 25 to the plate 21. Preferably, the struts are formed in one piece with the base plate 21. Alternatively, the struts can be secured to the base by a weld or other suitable attachment device or method. The struts can also be removably secured to the base, as by a pin or other suitable structure.

The deflecting device 1 has structure for holding the deflecting surface to the top of the struts 23, 25. In a preferred embodiment, the deflecting surface is provided by a diverting roller 27. This diverting roller can be held to fore and aft struts 23, 25 by a connection such as a bolt 29 passing through the fore strut 23, the center of the diverting roller 27 and the aft strut 25, with the diverting roller 27 being rotatable about the bolt 29. A nut 31 is tightened at the threaded end of the bolt 29 to secure the diverting roller 27 between the fore and aft struts 23, 25. The nut 31 can also be replaced by a cotter pin for quick release. In an alternative embodiment, the struts 23, 25 can have slots at the strut top, and the bolt can have corresponding circumferential grooves such that the bolt can be removably pressed into the strut slots to form a snap fit.

Figure 4:
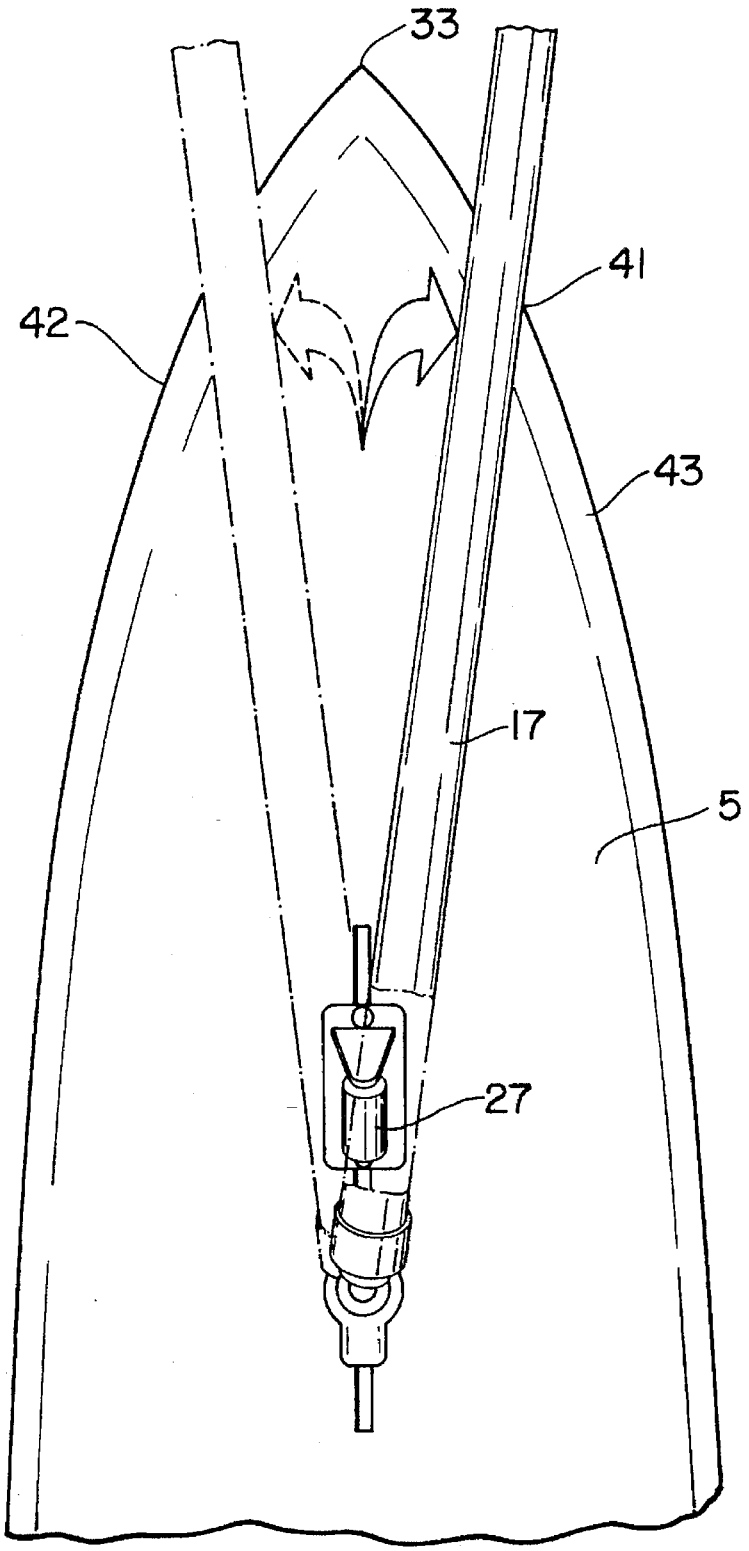
FIG. 4 is a partial top plan view of the mast deflecting device in a starboard deflecting engagement, with the port deflecting engagement shown in phantom.

In operation, when the mast is falling towards the bow 33, the mast 17 strikes the upper surface 35 of the diverting roller 27 at a portion 37 of the mast 17 (FIG. 2). Since the diverting roller 27 can rotate about the bolt 29, when the mast 17 strikes the diverting roller 27, the roller 27 rotates and diverts the mast 17 towards the port side 42 or starboard side 43 of the sailboard 5, depending on the position and direction of the mast before contact with the deflection device (FIG. 4).

To minimize wear to the mast and the deflecting device, the mast preferably strikes the deflecting surface 35 of the deflecting device 1 evenly. Accordingly, as shown in FIG. 2, the deflecting surface 35 of the deflecting roller 27 preferably is substantially parallel to the mast 17 when the mast 17 contacts the roller 27. It will be appreciated that this angle will change depending upon the distance that the deflecting device is positioned from the mast, the angle becoming more parallel to the sailboard surface as the distance from the mast increases.

A constant-angle deflecting roller 27 is shown in the embodiment of FIG. 2. Therein, the top of the fore strut 23 is higher than the top of the aft strut 25. The strut height asymmetry creates an angled deflecting roller 27 that places the top surface 35 of the deflecting roller 27 parallel to the striking surface 37 of the mast 17 when the mast falls and strikes the deflecting roller 27. Alternatively, the struts 23, 25 can be adjustable to change the angle of the deflecting roller 27 with respect to the sailboard 5. This adjustability of the deflecting roller permits the placement of the mast deflecting device 1 in a plurality of positions between the mast base 11 and the bow 33, because the angle of the deflecting roller 27 can be adjusted so that the mast will strike it evenly.

Figure 3:
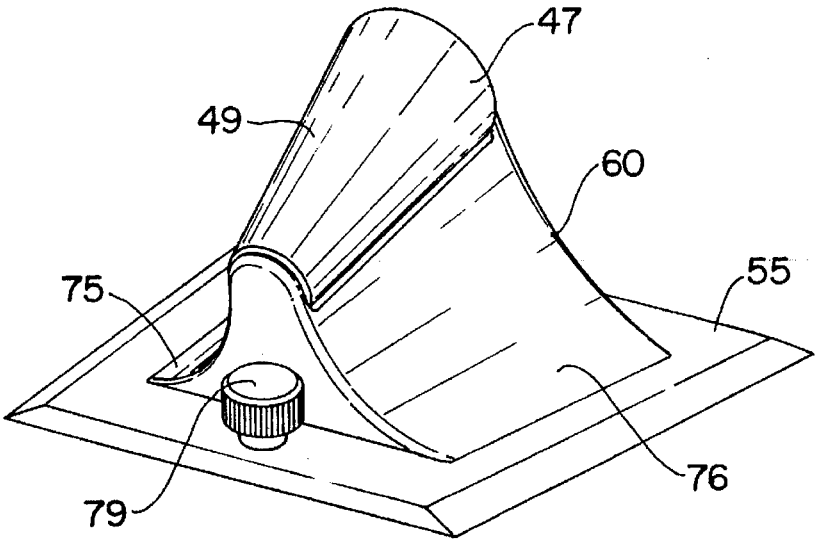
FIG. 3 is a perspective view of an alternative embodiment of the mast deflecting device.

FIG. 3 shows an alternative embodiment of the mast deflecting device. The mast deflecting device can be made entirely of one piece, with an angled or convexly-curved deflecting surface. In the embodiment that is shown, the base 55 and support 60 are one solid piece. The deflecting surface is convexly curved and can be a fixed portion of the device that is static in operation, or provided as a deflecting roller 47 having a deflecting surface 49 attached to the top of the support by suitable structure. The deflecting roller 47 that is shown is substantially conical in shape. The support assembly 60 can have port and starboard surfaces 75, 76 that extend either linearly or, preferably, are curved down to the base 55 and the top surface of the sailboard. The support assembly 60 is preferably made of a shock resistant plastic.

The starboard side 76 of the mast deflection device is shown to extend smoothly from the convex top surface 49 of the roller 47 down to the base 55. In operation, when the mast 17 strikes the deflecting surface 49 of this embodiment, and the mast is deflected, for example, to the starboard side (FIG. 4), the mast will slide from the deflecting surface 49 along the curved surface 76 to the base 55. The deflecting surface 49 of the mast deflection device in the preferred embodiment is angled so as to be parallel to the mast 17 at the point of impact, as described above. Fastening structure such as the bolt 79 can be provided to secure the device to the sailboard 5.

FIG. 4 shows the top view of the deflecting device in operation. As shown in FIG. 4, the mast 17 has rolled off the diverting roller 27 towards the starboard side of the board 5 and, instead of striking the bow 33, the mast is directed towards the starboard side of the board to glancingly strike the board 5 at a position 41 away from the bow 33.

Figure 5:
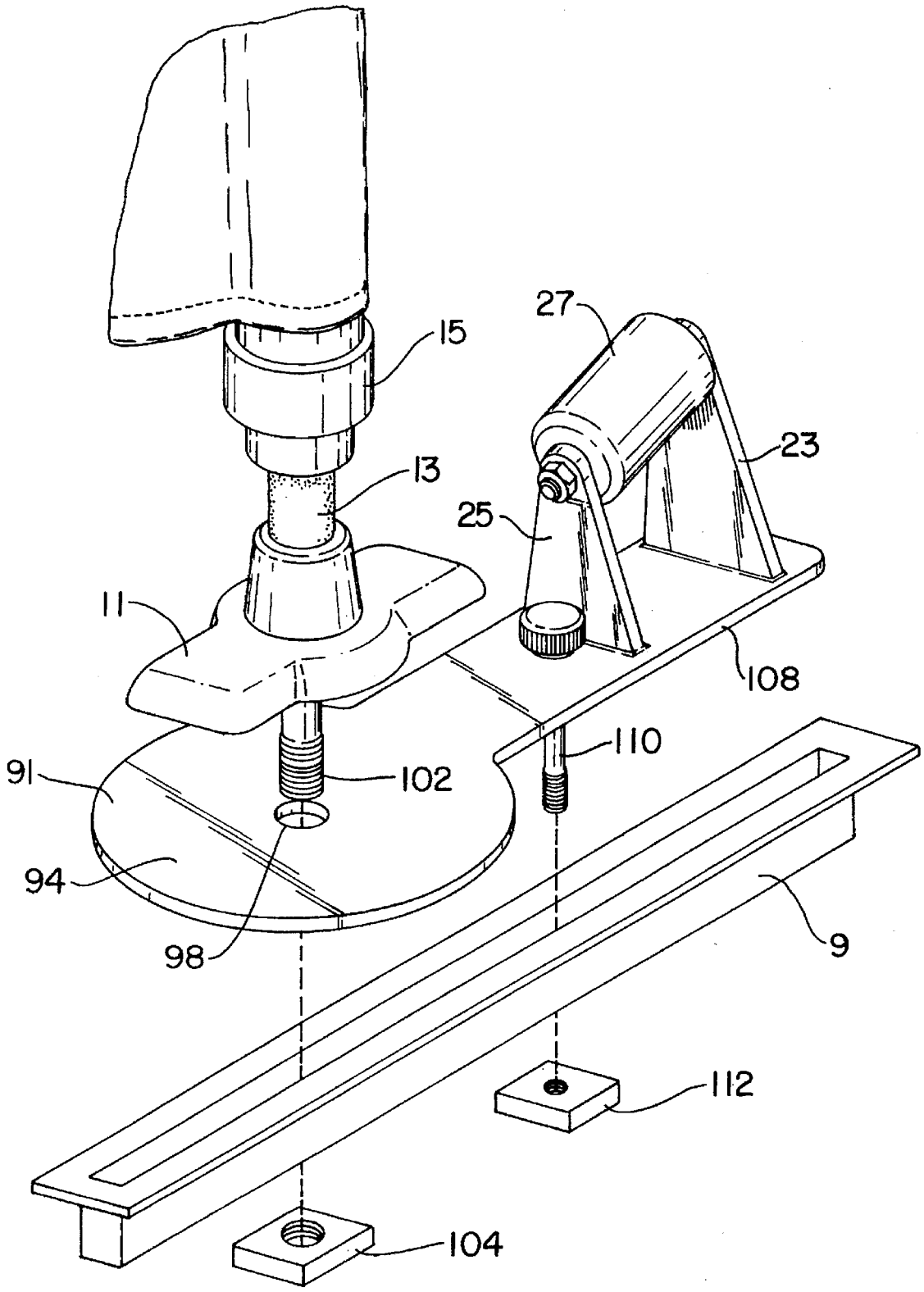
FIG. 5 is an exploded perspective view of another alternative embodiment of the mast deflecting device.

The mast deflecting device 1 can be provided on a mounting plate 91, as shown in FIG. 5. The mounting plate 91 can have a base portion 94 with an aperture 98. The threaded end 102 of the mast connector 13 can be placed through the aperture 98, and then into the mast track 9, where it can be joined to a threaded mast base fastener 104. The mounting plate 91 thus becomes secured to the sailboard 5. The mast deflecting device 1 is secured by suitable fastening structure to a tongue 108 or other mounting portion of the mounting plate 91. Fastening structure such as the bolt 110 can also be provided to secure the tongue 108 in position in the track 9 by making a threaded connection to a connector 112. It is also possible that, instead of the deflecting device fastener, the plate 91 could be provided with a rod (not shown) extending from the plate down into the mast track 9 such that the rod prevents sideways movement of the tongue 108.

Although the description of this invention has been given with reference to particular embodiments, this description should not be construed as limiting the scope of this invention. Many variations and modifications may now occur to those skilled in the art in view of this disclosure. Accordingly, the scope of the present invention should not be determined by the above description, but rather by a reasonable interpretation of the appended claims.

We claim:

1. An apparatus for preventing damage to the bow of a sailboard by a mast of the sailboard, said sailboard having an upper surface, the apparatus comprising:

a deflecting surface for deflecting said mast to one side or the other of said deflecting surface, and for permitting movement of said mast to a position which is substantially parallel and adjacent to said upper surface of the sailboard at either side of said deflecting surface;

a base; and, support structure for supporting the deflecting surface over the base and said upper surface of the sailboard.

2. The apparatus of claim 1, wherein said deflecting surface comprises a convex surface.

3. The apparatus of claim 1, wherein said deflecting surface is provided as a roller, said roller being rotatably mounted to said support structure.

4. The apparatus of claim 1, wherein said base comprises structure for securing said apparatus to a sailboard.

5. The apparatus of claim 4, wherein said securing structure comprises at least one bolt.

6. The apparatus of claim 1, further comprising a mounting plate, said mounting plate comprising structure for securing said mounting plate to said sailboard.

7. The apparatus of claim 6, wherein said structure for securing said mounting plate is at least one aperture adapted to receive structure for securing a mast to the sailboard, whereby the securing of the mast to the sailboard will secure the apparatus to the sailboard, and the deflecting surface will be positioned adjacent to the mast.

8. The apparatus of claim 1, wherein said support structure comprises curved sides.

9. The apparatus of claim 8, wherein said deflecting surface is provided as a roller, said roller being rotatably mounted to said support structure.

10. The apparatus of claim 8, wherein said support structure is solid.

11. The apparatus of claim 1, wherein said deflecting surface is at an angle relative to said base.

12. The apparatus of claim 11, wherein said angle is selected such that, upon installation on a sailboard, when said mast strikes said deflecting surface, said mast will be substantially parallel to said deflecting surface.

13. A method for preventing damage to the bow of a sailboard, said method comprising the steps of:

(a) providing a sailboard having a bow, a mast, and an upper surface with a longitudinal axis;

(b) providing apparatus having at least one deflecting surface for deflecting said mast to one side or the other of said deflecting surface; and, (c) positioning and fixing said apparatus to said sailboard forward of said mast and substantially along said longitudinal axis of said sailboard, with said deflecting surface positioned above said upper surface of the sailboard, said deflecting surface permitting movement of said mast to a position substantially parallel and adjacent to said upper surface of the sailboard at either side of said deflecting surface, whereby said mast, when falling forward toward said bow, will strike said deflecting surface and will be directed to either lateral side of said sailboard and away from said bow.

14. The method claim 13, wherein said positioning and fixing steps comprise the step of attaching said mast to said sailboard.

15. The method of claim 14, whereby said apparatus is provided on a mounting plate with an aperture for receiving mast connection structure, and said positioning and fixing steps comprise the step of passing said mast connection structure through said aperture and connecting said mast to said sailboard, whereby the connection of said mast to said sailboard will position and secure said apparatus to said sailboard.

16. A sailboard, comprising:

a board having an upper board surface, a bow, and a longitudinal axis;

a mast and boom assembly; and at least one deflecting surface, said deflecting surface being positioned forward of said mast, above said upper board surface, and substantially along said longitudinal axis of said board, said deflecting surface deflecting said mast to one side or the other of said deflecting surface, and permitting movement of said mast to a position which is substantially parallel and adjacent to said upper board surface at either side of said deflecting surface, whereby said mast and boom assembly, when falling forward toward said bow, will strike said deflecting surface and will be directed to either lateral side of said sailboard and away from said bow.

* * * * *